US008944861B2

(12) United States Patent
Amano et al.

(10) Patent No.: US 8,944,861 B2
(45) Date of Patent: Feb. 3, 2015

(54) TERMINAL FITTING AND METHOD OF PRODUCING IT

(71) Applicant: Sumitomo Wiring Systems, Ltd., Yokkaichi (JP)

(72) Inventors: Takamaru Amano, Yokkaichi (JP); Tsutomu Tanaka, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 58 days.

(21) Appl. No.: 13/863,784

(22) Filed: Apr. 16, 2013

(65) Prior Publication Data

US 2013/0288547 A1 Oct. 31, 2013

(30) Foreign Application Priority Data

Apr. 26, 2012 (JP) ..... 2012-101372

(51) Int. Cl.
*H01R 11/22* (2006.01)
*H01R 13/11* (2006.01)

(52) U.S. Cl.
CPC ..... *H01R 13/11* (2013.01); *H01R 13/113* (2013.01)
USPC ..... 439/852

(58) Field of Classification Search
USPC ..... 439/851, 852, 845, 839, 660
See application file for complete search history.

(56) References Cited

U.S. PATENT DOCUMENTS

| | | | | |
|---|---|---|---|---|
| 5,540,603 | A * | 7/1996 | Fujiwara | 439/851 |
| 5,839,925 | A * | 11/1998 | Simmons | 439/852 |
| 6,244,910 | B1 * | 6/2001 | Grubbs | 439/852 |
| 6,264,509 | B1 * | 7/2001 | Kwang et al. | 439/852 |
| 6,752,660 | B2 * | 6/2004 | Fujita et al. | 439/595 |
| 7,144,281 | B2 * | 12/2006 | Maeda | 439/852 |
| 7,156,704 | B2 * | 1/2007 | Shimizu | 439/852 |
| 7,347,747 | B2 * | 3/2008 | Shimizu | 439/852 |
| 7,458,864 | B2 * | 12/2008 | Philipp | 439/851 |
| 8,241,075 | B2 * | 8/2012 | Ishikawa et al. | 439/851 |
| 8,454,394 | B2 * | 6/2013 | Iihoshi | 439/852 |
| 8,662,935 | B2 * | 3/2014 | Jouas et al. | 439/660 |
| 2003/0224668 | A1 * | 12/2003 | Matsuda | 439/839 |
| 2011/0294366 | A1 * | 12/2011 | Iihoshi | 439/852 |
| 2012/0252283 | A1 * | 10/2012 | Muro | 439/839 |
| 2013/0288548 | A1 * | 10/2013 | Amano et al. | 439/852 |

* cited by examiner

*Primary Examiner* — Alexander Gilman
(74) *Attorney, Agent, or Firm* — Gerald E. Hespos; Michael J. Porco; Matthew T. Hespos

(57) ABSTRACT

A terminal fitting has a rectangular tube (2) with a ceiling plate (8). A struck portion (19) is formed by striking an extending end edge of the ceiling plate (8) inwardly of the rectangular tube (2) while maintaining a plate thickness. The inner surface of this struck portion (19) is at the same height as the projecting end of a ceiling plate side contact portion (18) and the outer surface of the struck portion (19) is at the same height as the inner surface of the ceiling plate (8) around the contact portion. A pressing portion (9) is bent from the upper end edge of a second side plate (5) to extend substantially parallel to a bottom plate (3) and contacts the outer surface of the struck portion (19). The pressing portion (9) does not project in a height direction from the ceiling plate (8).

10 Claims, 11 Drawing Sheets

TERMINAL FITTING AND METHOD OF PRODUCING IT

BACKGROUND

1. Field of the Invention

The invention relates to a terminal fitting and a method of producing it.

2. Description of the Related Art

Generally, a female terminal fitting includes a rectangular tube into which a male tab is inserted. The rectangular tube is formed by a pair of side plates that stand at right angles from opposite left and right side edges of a bottom plate. A ceiling plate extends from the upper edge of one side plate to the upper edge of the other side plate. A pressing portion extends from the upper end edge of one side plate to the bottom plate and is placed on the ceiling plate to prevent it from opening. When the pressing portion is placed over the ceiling plate, the rectangular tube is often too bulky.

U.S. Pat. No. 7,347,747 discloses recessing an area of the ceiling plate where the pressing portion is to be placed by pressing to make the terminal fitting less bulky. However, pressing the ceiling plate creates other problems as explained herein.

In addition to adding to the bulk of the terminal fitting, the pressing portion limited the number of terminal fittings that could be coupled to a carrier. Generally, several terminal fittings are coupled to a carrier in a chain-like manner before the rectangular tube fitting is formed. When the pressing portion is pressed into the ceiling area of the plate, the narrow intervals between adjacent terminal fittings are deformed because the parts to be pressed are located at opposite ends of the terminal fittings. Therefore, the pressing plate required adjacent terminal fittings to be set sufficiently far apart to allow for the expansion caused by the pressing. There is also a concern that the pressing could cause a local thinning of the plating layer.

The invention was developed to increase the number of terminal fittings that can be coupled to a carrier and to make the terminal fitting less bulky.

SUMMARY OF THE INVENTION

The invention provides for a terminal fitting, comprising a tube into which a mating terminal is at least partly insertable. The tube portion includes: (i) a base plate, (ii) a pair of side plates projecting from side edges of the base plate, and (iii) a ceiling plate bent from the distal end edge of one side plate and extending, in parallel to the base plate, to the other side plate where a receiving portion is formed. The ceiling plate is deformed to project inward from the tube, which allows for contact with the mating terminal while maintaining the plate thickness because the outer surface of the bent portion is set at or below the height of the inner surface of the ceiling plate at the contact portion. At least one pressing portion is bent from the distal end edge of the other side plate to extend parallel to the base plate and the ceiling plate is prevented from opening by the contact of the pressing portion with the outer surface of the bent portion.

The side plates preferably stand up substantially at a right angle from opposite side edges of the base plate.

A height difference between the projecting end of the contact portion and the inner surface of the ceiling plate around the contact portion preferably is set to be not smaller than the plate thickness of walls forming the tube.

The contact portion is formed by striking, hammering, embossing or deforming the ceiling plate to project from the inner surface of the ceiling plate by more than the plate thickness. The struck or bent portion is at the same height as or below where the contact portion is formed, which allows outer surface of the pressing portion to be at the same height as or below the ceiling plate rather than projecting outwardly, which allows the height of the terminal fitting to be reduced. In addition, because the plate thickness of the struck or bent portion is maintained there is no actual pressing by the pressing portion and no corresponding extensional deformation. Eliminating the extensional deformation allows more terminal fittings to be coupled to a carrier in a chain-like manner because less space is required between each terminal fitting. The dead space created in a height direction by the formation of the contact portion also has the practical effect of further restricting the opening of the ceiling plate.

The contact portion and the struck or bent portion preferably are arranged, widthwise, at opposite sides of the center line of the rectangular or polygonal tube and the projecting end of the contact portion and the inner surface of the bent or struck portion are the same height. This enables the contact portion and the bent potion to contact the mating terminal at opposite widthwise sides. Thus, even if the mating terminal is tab-shaped, rolling is restricted and an electrically conductive state can be stabilized.

The receiving portion may be formed by making one or a series of longitudinal cuts in the other side plate causing the other side plate to project into the tube. The cut side then becomes a base or bottom surface of one or a series of semi-conical shapes, and the end surface of the cut side of the projecting parts can form one or a series of flat surfaces perpendicular to the other side plate thereby allowing the extending edge of the side plate to be reliably received.

When the mating terminal is inserted to a proper depth in the tube portion, the formation range of the contact portion may extend more backward than the leading end of the mating terminal.

The contact portion may have a semicircular front cross-sectional shape and/or the height difference between the projecting end of the contact portion and the inner surface of the ceiling plate around the contact portion may be equal to the plate thickness of the terminal fitting and/or the bent portion may have a length equal to the formation range of the contact portion.

These and other objects, features and advantages of the invention will become more apparent upon reading the following detailed description of the embodiments and the accompanying drawings. It should be understood that even though embodiments are separately described, single features thereof may be combined to additional embodiments.

DETAILED DESCRIPTION OF THE PREFERRED EMBODIMENTS

Figure 5:
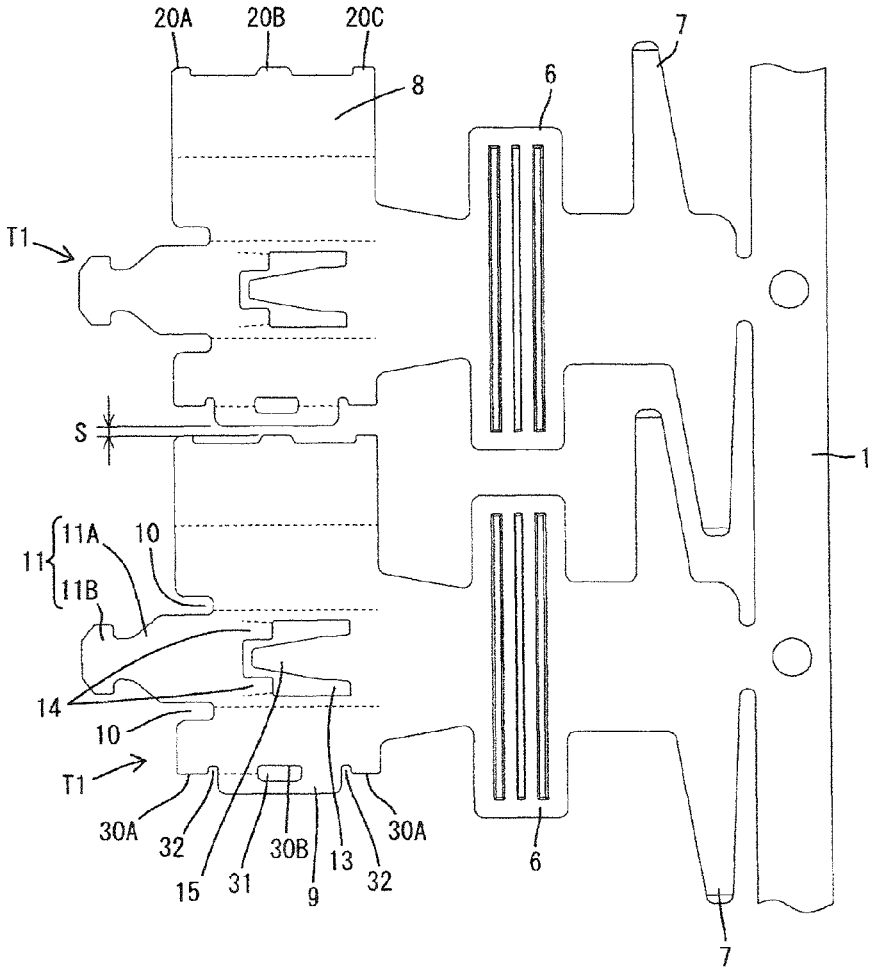
FIG. 5 is a plan view showing the terminal fitting in a developed state.

FIGS. 1 to 6 show a first particular embodiment of the present invention. As shown in FIG. 5, a terminal fitting T1 according to the first embodiment is in a developed state after a conductive plate material is punched or cut out into a specified shape. A multitude of terminal fittings T1 in the developed state are coupled to a carrier 1 in a chain-like manner in a longitudinal direction of the carrier 1. The terminal fittings T1 in the developed state are cut off from the carrier 1 in a later step and assembled as the terminal fittings T1 having a desired shape after respective bending, folding, embossing, punching, stamping and/or striking steps.

A hollow (in forward and backward directions) rectangular or polygonal tube 2 is formed on or near the front of each terminal fitting T1 and a wire connection portion comprising at least one wire barrel 6 to be crimped and connected to a wire core and at least one insulation barrel 7 to be crimped and connected to a wire coating to be connected to a wire is formed on the back.

The tube 2 includes a bottom plate 3, a first side plate 4, a second side plate 5, a ceiling plate 8 and a pressing portion 9. As shown in FIG. 5, grooves 10 are formed on or near the front edge of the bottom plate 3 while being spaced apart in a width direction WD and a tongue 11 which can come into contact with the lateral or lower surface of a mating terminal M extends forward between the grooves 10. This tongue 11 is folded backward in the tube 2. A folded part is arcuately curved and the tongue 11 is resiliently deformable in a height direction (or a direction intersecting with an insertion direction of the tab into the tube 2) with the folded part as a support. As shown in FIG. 5, a length area of the tongue 11 behind the folded part is formed to become gradually narrower toward the back 11A and a wider area 11B is at a rear end part of the tongue 11 and bulges out sideways, toward widthwise sides. A tongue side contact portion 12 is formed from the narrow area 11A to the wide area 11 B on the upper surface of the tongue 11. The tongue side contact portion 12 projects in a widthwise intermediate or central part located on a center line with respect to the width direction WD of the rectangular tube on the upper or inner surface of the tongue 11 and has a pointed front end to become gradually wider toward the rear.

Figure 3:
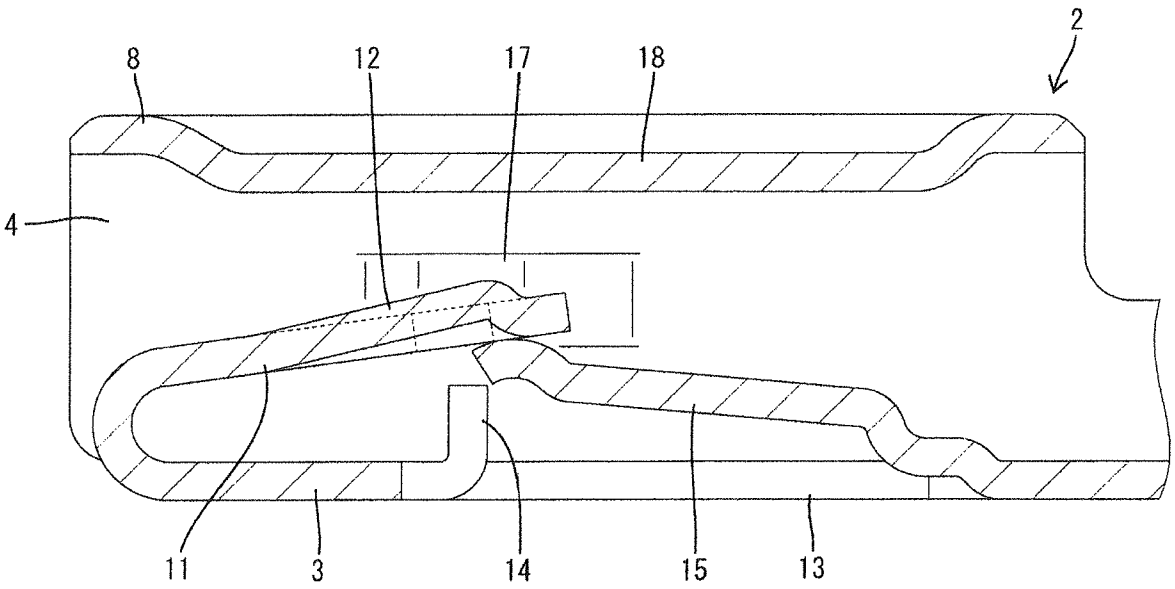
FIG. 3 is a side view in section of the terminal fitting.
Figure 4:
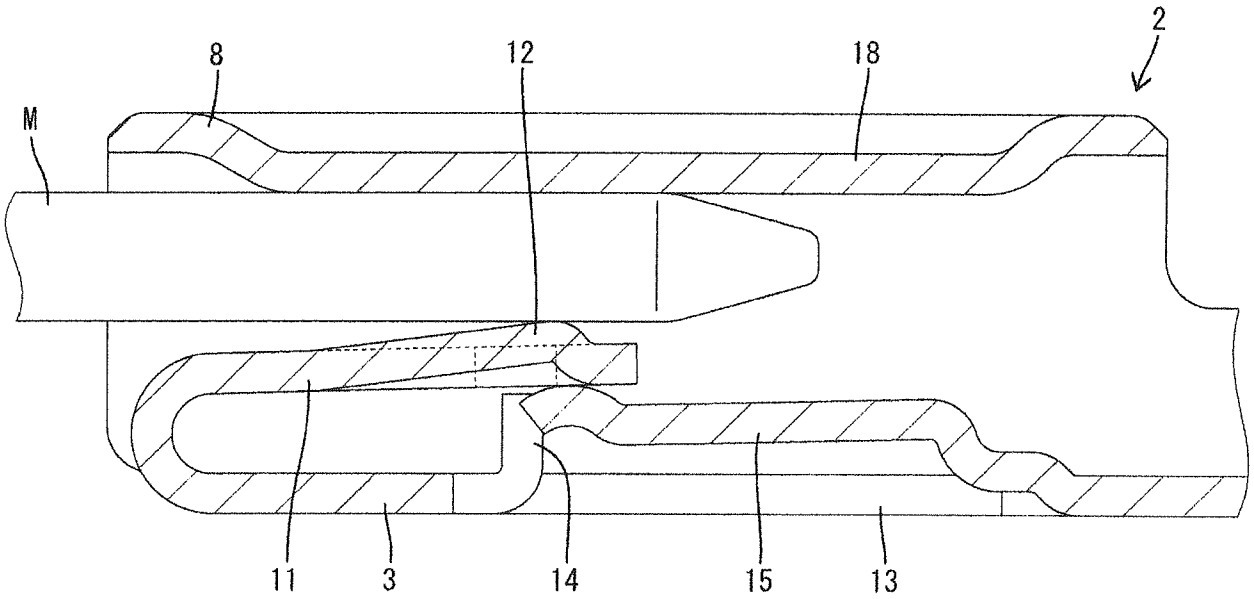
FIG. 4 is a section showing a state where a mating terminal is inserted in a rectangular tube portion.

As shown in FIGS. 3 and 5, a punched hole 13 is formed in a longitudinal central and intermediate part of the bottom plate 3. One or more excessive deformation preventing pieces 14 for the tongue 11 are arranged at or near the punched hole 13, on opposite widthwise end portions of the front side of the opening edge of the punched hole 13. The excessive deformation preventing pieces 14 stand up or project at an angle, preferably at a right angle, and project inward of the tube 2 and can contact the lower surfaces of opposite left and right end parts of the wide area 11B of the tongue 11, when the piece 11 is resiliently deformed by a specified angle. Note that the excessive deformation preventing pieces 14 are set at such a height as not to come into contact with the tongue 11 in a state where the mating terminal M is inserted in a proper posture (state shown in FIG. 4). Further, the punched hole 13 functions as a locking hole, into which a locking lance for retaining the terminal fitting T1 in a connector housing is to be inserted, particularly after an auxiliary spring piece 15 is bent and raised.

As shown in FIGS. 3 and 5, the auxiliary spring piece 15 resiliently deformably extends forward from the rear side of the opening edge of the punched hole 13. As shown in FIG. 5, the auxiliary spring piece 15 is formed to become gradually narrower and the front end arcuately projects inwardly or upward and/or is constantly held in contact with the lower or outer surface of the rear end of the tongue 11 (may be slightly spaced apart in a natural state and come into contact after the start of the resilient deformation of the tongue 11).

Figure 2:
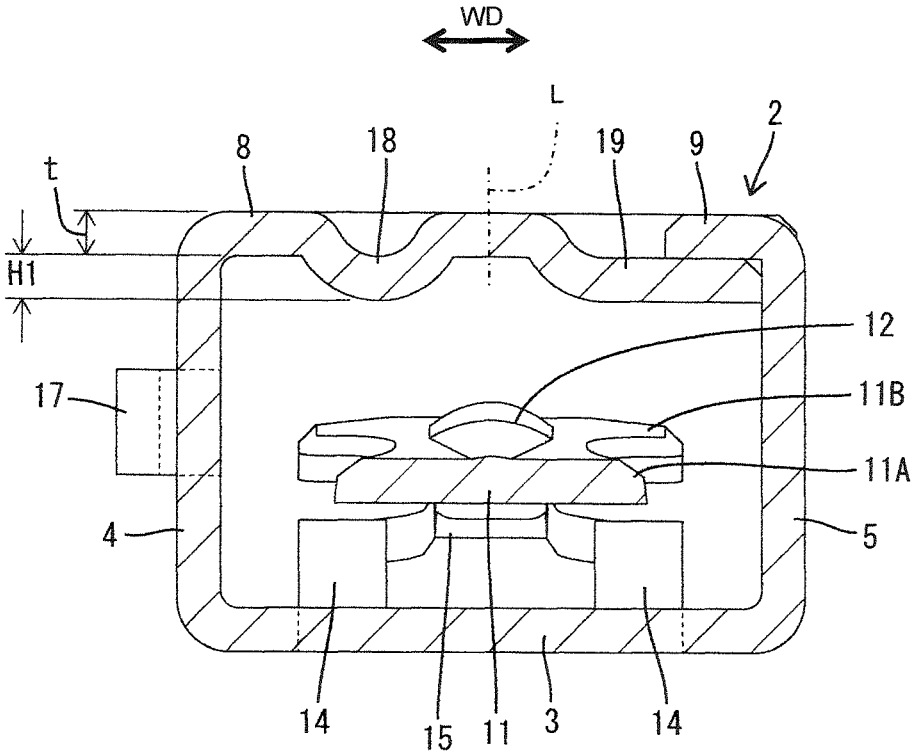
FIG. 2 is a section along A-A of FIG. 1.

As shown in FIG. 2, the first side plate 4 stands up or projects at an angle, preferably at a right angle from the bottom plate 3 (the shown left side edge) and the second side plate 5 stands up or projects at an angle, preferably at a right angle from the other side of the bottom plate 3 (the shown right side edge). At least one stabilizer 17 projects in a central intermediate part of the first side plate 4 in a height direction and/or a longitudinal direction. The stabilizer 17 interferes with the wall surface of a cavity to prevent insertion when the terminal fitting T1 is inserted in an improper posture (e.g. vertically inverted posture) into the cavity of the unillustrated connector housing.

Figure 1:
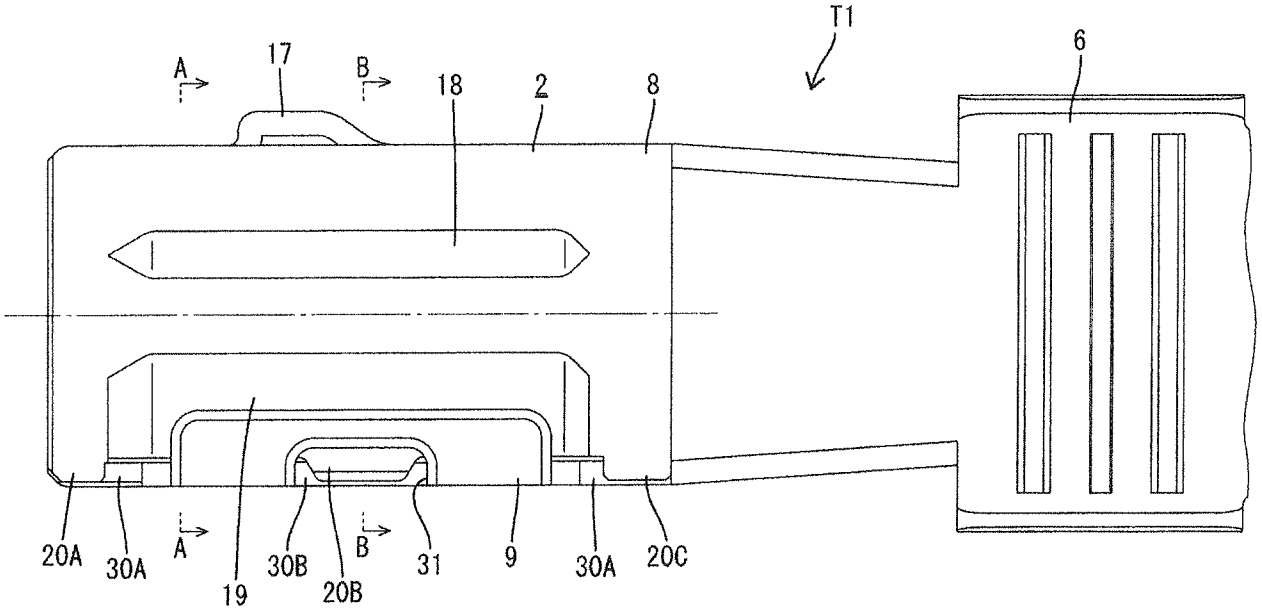
FIG. 1 is a plan view of a terminal fitting of a first embodiment.

The ceiling plate 8 extends from the upper or distal end edge of the first side plate 4 toward the second side plate 5 in parallel to the bottom plate 3. As shown in FIG. 2, a ceiling plate side contact portion 18 for the mating terminal M is arranged at a position of the ceiling plate 8 displaced toward the first side plate 4 from a center line L with respect to the width direction WD. The ceiling plate side contact portion 18 is formed by deforming the tube 2 inward. Further, as shown in FIG. 1, the ceiling plate side contact portion 18 extends in a rib-like manner along the longitudinal direction of the ceiling plate 8. A formation range of the ceiling plate side tongue 18 is a range extending more backward than the leading end position of the mating terminal M in a state where the mating terminal M is inserted to a proper depth in the rectangular tube 2 (see FIG. 4).

As shown in FIG. 2, the ceiling plate side contact portion 18 has a substantially semicircular front cross-sectional shape and a height difference (H1 in FIG. 2) between the lowest end (projecting end) of the ceiling plate side contact portion 18 and the inner surface of the ceiling plate 8 around the ceiling plate side contact portion 18 is set to be equal to the plate thickness (t in FIG. 2) of the terminal fitting T1. An extending end of the ceiling plate 8 is deformed inwardly of the rectangular tube 2 to form a struck portion 19.

As shown in FIG. 1, the struck portion 19 is to the side of the center line L of the tube 2 with respect to the width direction WD opposite to the ceiling plate side contact portion 18 and is formed in a rectangular area long in the longitudinal direction. The struck portion 19 has a length equal to the formation range of the ceiling plate side contact portion 18 in the longitudinal direction. In addition, as shown in FIG. 5, projecting pieces 20A to 20C bulge out in the width direction WD at front and/or rear end parts and/or an intermediate/central part) of the extending end edge of the ceiling plate 8 in the longitudinal direction. As shown in FIG. 1, a struck or deformed area defining the ceiling plate side contact portion 18 extends between the projecting pieces 20A and 20C located on the front and rear ends out of the respective projecting pieces 20A to 20C and includes the projecting piece 20B located in the center or intermediate position. Wall surfaces forming a peripheral edge part of the struck portion 19 (excluding a wall surface on the extending end edge) are slanted, but the other entire area of the struck portion 19 is parallel to the bottom plate 3. Further, the height of the inner surface of the struck portion 19 is set to equal that of the lowest or innermost end of the ceiling plate side contact portion 18. Thus, both the inner surface of the struck portion 19 and the ceiling plate side contact portion 18 can come into contact with a surface of the mating terminal M. The height of the outer surface in the struck portion 19 is lower or arranged more inward than a general surface of the ceiling plate 8 (surface in areas other than the ceiling plate side contact portion 18 and the struck portion 19) by a height corresponding to the plate thickness.

Front and rear receiving portions 30A, 30A are formed on substantially opposite end parts of the upper end surface of the second side plate 5 in forward and backward directions and come into contact with the respective projecting pieces 20A, 20C located on the front and rear ends of the ceiling plate 8 by being placed from above or outside. A pressing portion 9 for preventing the opening of the tube 2 is formed adjacent to the receiving portion 30A on the second side plate 5, between both receiving portions 30A, 30A on the upper end surface of the second side plate 5.

Figure 6:
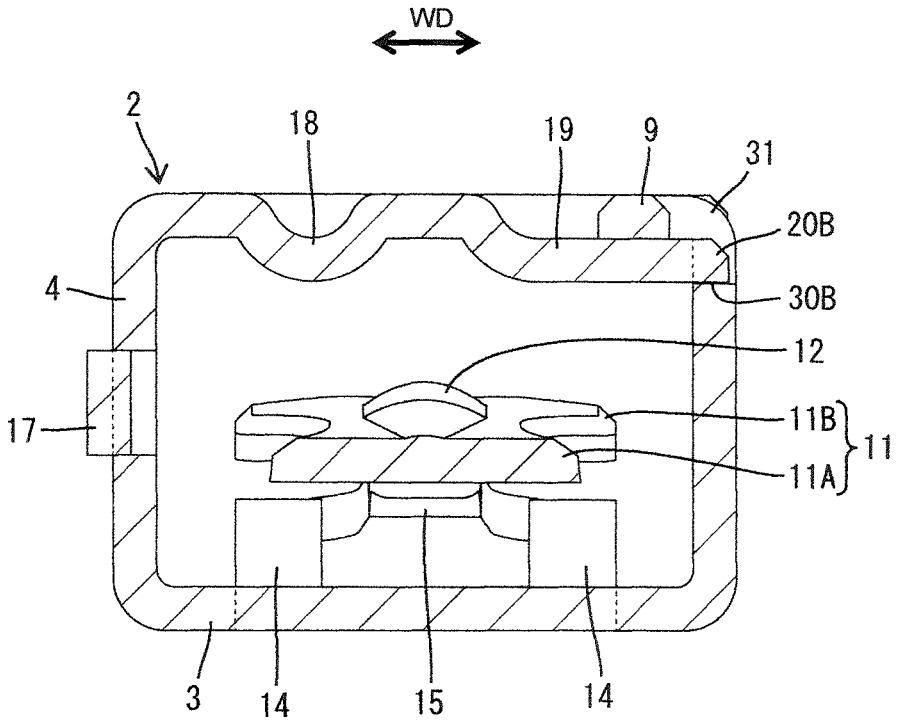
FIG. 6 is a section along B-B of FIG. 1.

As shown in FIG. 5, the pressing portion 9 is formed between recessed grooves 32 spaced apart in forward and backward directions and projects more outward than both receiving portions 30A in the width direction. The pressing portion 9 is bent at an angle, preferably at a right angle from the upper or distal end edge of the second side plate 5, and contacts the upper or outer surface of the struck portion 19 by being placed from above or outside. As described above, since the outer surface of the struck portion 19 is arranged lower or more inward than the general outer surface of the ceiling plate 8 by the plate thickness, the pressing portion 9 does not project upward or outward from the general surface of the ceiling plate 8. Further, at least one window hole 31 (long in forward and backward directions) is formed in a longitudinal central and intermediate part of the pressing portion 9. As shown in FIG. 6, the window hole 31 is formed from an upper end part of the second side plate 5 to the pressing portion 9. The projecting piece 20B located in the longitudinal central and intermediate position between the respective projecting pieces 20A to 20C of the ceiling plate 8 is inserted into the window hole 31 and contacts the lower side of the opening edge of the window hole 31 as a receiving portion 30B by being placed from above or outside. Note that the receiving portion 30B located in the longitudinal center is lower than the other receiving portions 30A located before and after this in the height direction by the plate thickness.

In the first embodiment described above, the ceiling plate side contact portion 18 and the struck or bent portion 19 are performed when the terminal fittings T1 are coupled in a chain-like manner in the developed state as shown in FIG. 6. The deformed or striking step for the struck portion 19 is performed so as not to cause any change in the plate thickness. Accordingly, an interval between the projecting piece 20B located in the longitudinal center and the side edge of the pressing portion 9 is smallest (dimension S shown in FIG. 5) between adjacent terminal fittings T1 in the developed state. The setting of this interval is subject to restriction based on the strength of a press die for punching out the terminal fittings T1 from a base material and based on expansion associated with striking. However, in this embodiment expansion associated with striking does not have to be considered and interval S may be set to equal the interval necessary to maintain the strength of the press die which is the smallest possible interval between terminal fittings. Therefore, the maximum number of terminal fittings may be attached to a connector in a chain like manner because the intervals between each terminal fitting T1 can be set as narrow as possible. In addition, because no pressing step is performed plating layers of the terminal fittings T1 are not thinned.

The height of the tube 2 is reduced because the ceiling plate side contact portion 18 is formed by recessing the ceiling plate 8 by a dimension corresponding to the plate thickness from the general surface and/or the struck or bent portion 19 is formed to have the same depth as the recess. This makes the struck or bent portion 19 lower than the general surface of the ceiling plate 8 by a dimension corresponding to the plate thickness, the pressing portion 9 placed on the upper surface of the struck portion 19 does not project upward or outward from the general surface of the ceiling plate 8 and does not add to the height of the rectangular or polygonal tube portion 2. In addition, the struck or bent portion 19 is formed within a range of the striking height of the ceiling plate side contact portion 18 effectively utilizing a dead space created lateral to the ceiling plate side contact portion 18, therefore, space in the tube 2 in the height direction is not restricted by the formation of the struck portion 19.

In addition, because the projecting end of the ceiling plate side contact portion 18 and the inner surface of the struck portion 19 are set at the same height position and spaced apart cross the center line L of the tube 2 with respect to the width direction WD, the mating terminal M can come into contact with the ceiling plate side contact portion 18 and the struck portion 19 in a stable posture in cooperation with the tongue side contact portion 12 without rolling the mating terminal M.

Figure 7:
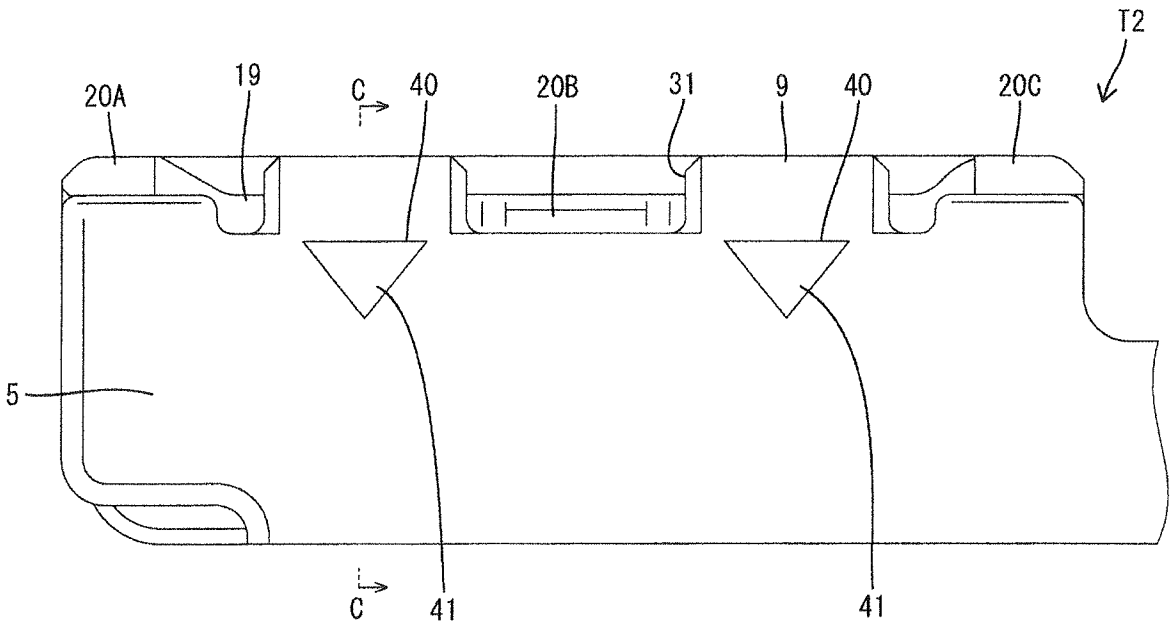
FIG. 7 is a side view showing a part of a terminal fitting of a second embodiment.
Figure 8:
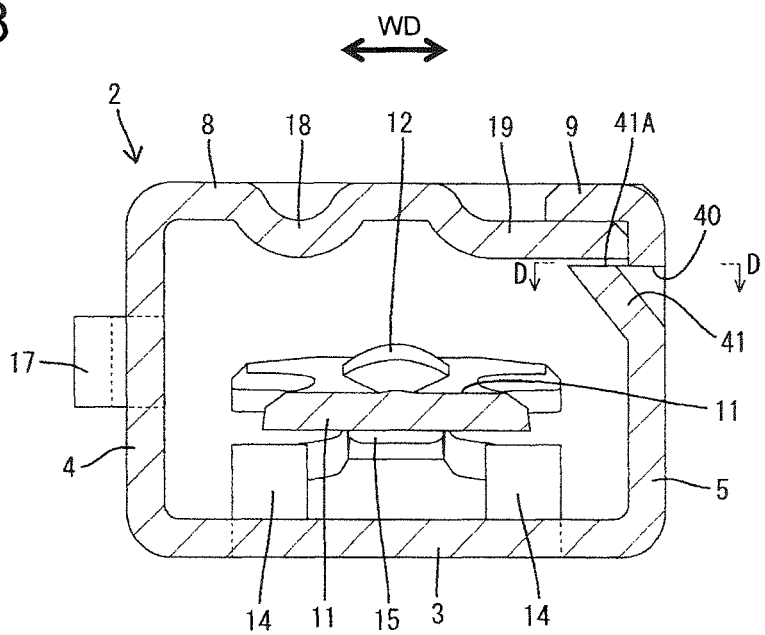
FIG. 8 is a section along C-C of FIG. 7.
Figure 9:
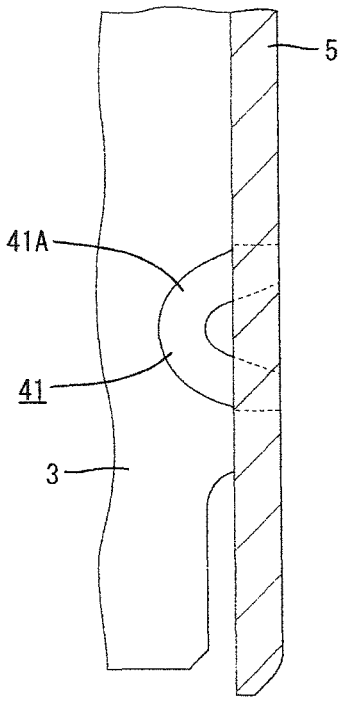
FIG. 9 is a section along D-D of FIG. 8.

FIGS. 7 to 9 show a terminal fitting T2 of a second embodiment of the invention that differs from the first embodiment in a structure for supporting a ceiling plate 8 by one or more receiving portions 41.

A pressing portion 9 provided on the upper or distal end edge of a second side plate 5 is bent at an angle, preferably at a right angle, with respect to the second side plate 5 and placed in close contact with the upper surface of a struck portion 19. Cuts 40 extending in a longitudinal direction are made at positions spaced apart near an upper end part of the second side plate 5 and at front and rear sides of a window hole 31. The height or position at which these cuts 40 are made is equal to the heights or positions of the projecting end of a ceiling plate side contact portion 18 and/or the inner surface of the struck portion 19 as shown in FIG. 8. Parts below the cuts 40 in the second side plate project inwardly of a rectangular or polygonal tube 2 and, at that time, the projecting parts have a semi-conical shape pointed downward and the cut side becomes a bottom surface.

As shown in FIG. 8, upper surfaces 41A of the receiving portions 41 are horizontal surfaces perpendicular to the second side plate 5 and/or at the same height as the inner surface of the struck portion 19. The extending end edge of the ceiling plate 8 comes into contact with the upper or distal end surfaces of the both receiving portions 41 by being placed from above or outside. The pressing portion 9 to be bent thereafter presses the extending end edge of the ceiling plate 8 from above. Allowing the ceiling plate 8 to resist a downward acting external force and/or be held in a closed state.

Other configurations are similar or same as in the first embodiment and, hence, similar functions and effects can be achieved.

Figure 10:
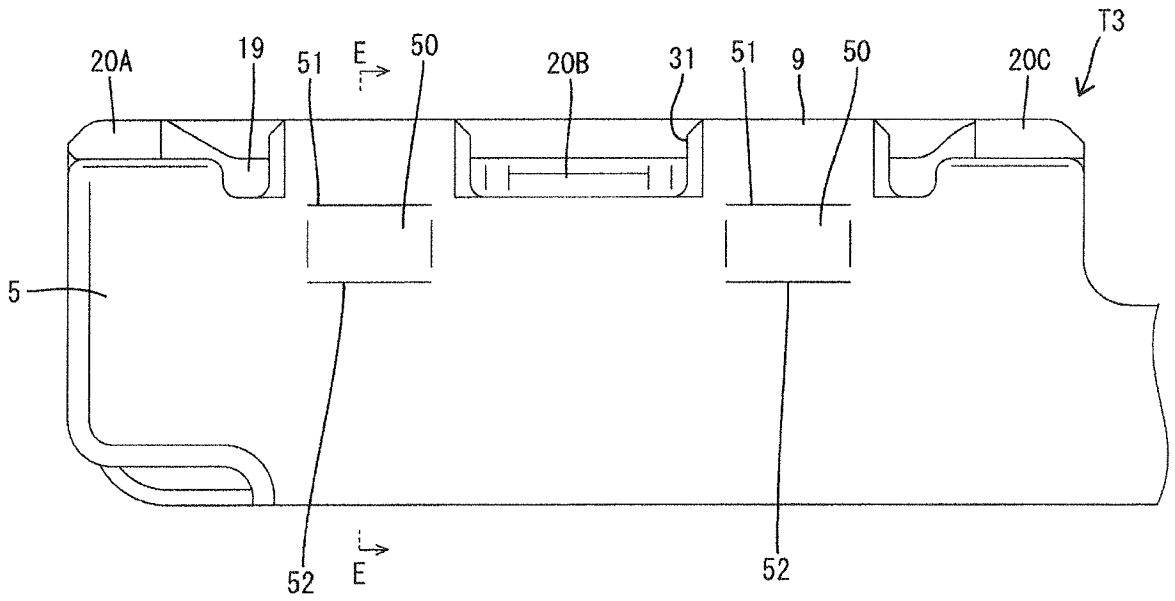
FIG. 10 is a side view showing a part of a terminal fitting of a third embodiment.
Figure 11:
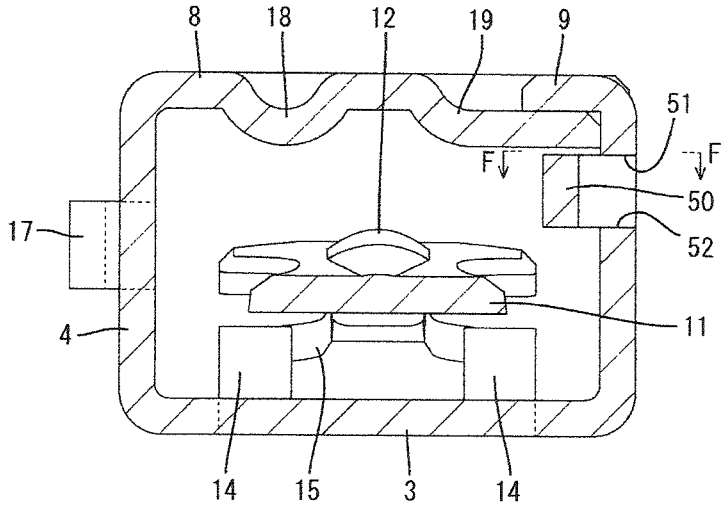
FIG. 11 is a section along E-E of FIG. 10.
Figure 12:
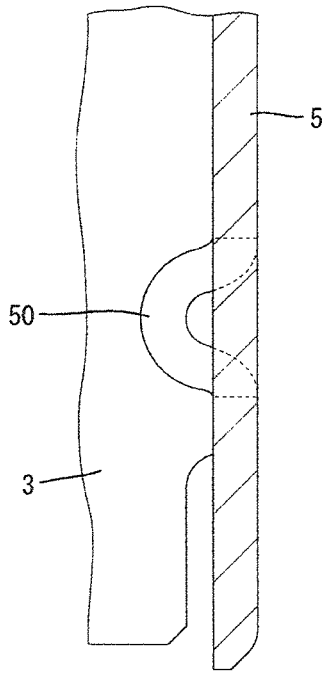
FIG. 12 is a section along F-F of FIG. 11.

FIGS. 10 to 12 show a terminal fitting T3 of a third embodiment of the invention. The third embodiment differs from the second embodiment in the shape of receiving portions 50. In the third embodiment, another cut 52 is made below a cut 51 made similarly to cut 40 in the second embodiment. An area between cuts 51 and 52 on a second side plate 5 is caused to project inwardly of a rectangular or polygonal tube 2. This projecting part serves as the receiving portion 50 and substantially has a semi-cylindrical shape whose axial center extends in a height direction.

The receiving portions 50 achieve functions and effects similar to those of the second embodiment, but are more easily formed than the receiving portions of the second embodiment.

Other configurations are similar or same as in the first and second embodiments and, hence, similar functions and effects can be achieved.

Figure 13:
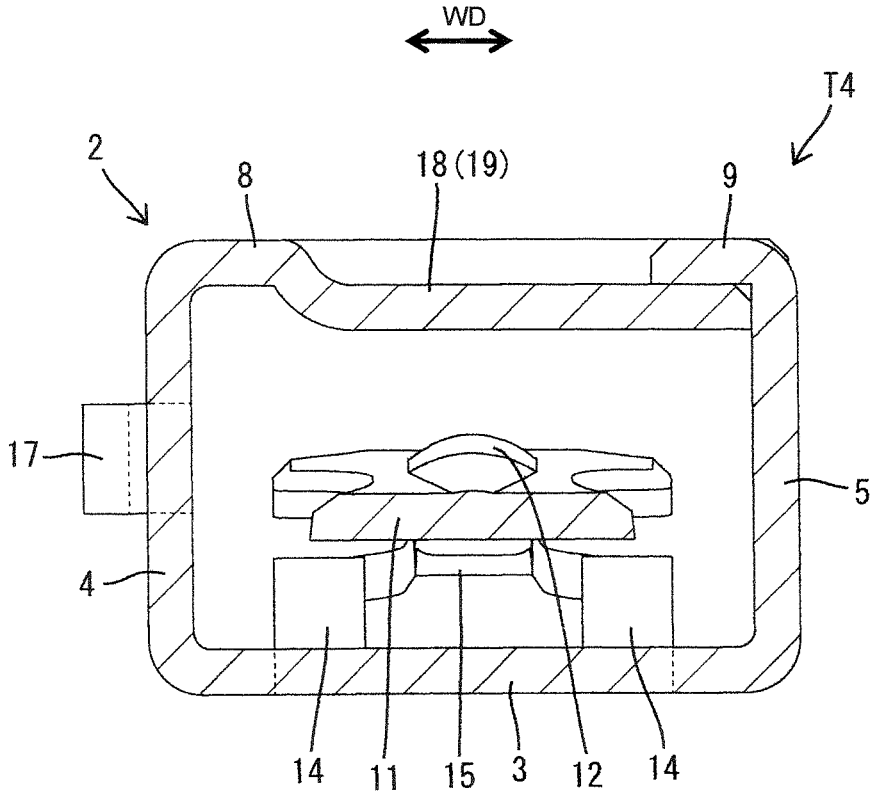
FIG. 13 is a section of a terminal fitting of a fourth embodiment.

FIG. 13 shows a fourth embodiment of the invention. In any of the first to third embodiments, the general surface of the ceiling plate 8 is located between the ceiling plate side contact portion 18 and the struck or bent portion 19 and the ceiling plate side contact portion 18 and the struck or bent portion 19 are spaced apart across the widthwise center of the ceiling plate 8.

However, in the fourth embodiment, a ceiling plate 8 is deformed (e.g. struck or embossed or bent) such that a ceiling plate side contact portion 18 and a struck or bent portion 19 are continuous without forming any boundary. Specifically, the ceiling plate 8 is struck to have a substantially uniform depth over a width range extending from a position near a first side plate 4 to the extending end edge thereof, and the inner surface of this struck or bent part can be held in surface contact with a mating terminal M over a specified width range. The depth of this struck or bent part corresponds to a plate thickness as in the other embodiments.

Other configurations are similar or same as in the other embodiments and, hence, similar functions and effects can be achieved.

The invention is not limited to the above described and illustrated embodiments. For example, the following embodiments are also included in the technical scope of the present invention.

The height differences from the inner surface of the struck portion 19 and the projecting end of the ceiling plate side contact portion 18 to the inner general surface of the ceiling plate 8 may be set to be larger than the plate thickness provided that the outer surface of the pressing portion 9 does not project outward from the general surface of the ceiling plate 8 when the pressing portion 9 is placed on the outer surface of the struck portion 19.

The inner surface of the struck portion 19 may be set to be higher, i.e. located more outward.

What is claimed is:

1. A terminal fitting, comprising a tube for receiving a mating terminal, the tube including, a base plate with opposite first and second sides;

first and second side plates projecting respectively from first and second sides of the base plate; and a ceiling plate bent from an end of the first side plate opposite the base plate and extending substantially parallel to the base plate, an extending end edge thereof being supported in contact with a receiving portion formed on the second side plate;

the ceiling plate being shaped to project inwardly of the tube to form a contact portion with the mating terminal;

the extending end edge part of the ceiling plate being deformed inwardly of the tube while maintaining a uniform plate thickness, thereby forming a bent portion, and the bent portion having an outer surface set at the same height position as or below the inner surface of the ceiling plate at locations disposed laterally of and adjacent to the contact portion; and at least one pressing portion bent from an end of the second side plate opposite the base plate to extend substantially in parallel to the base plate so that opening of the ceiling plate is prevented by contact of the pressing portion with the outer surface of the bent portion.

2. The terminal fitting of claim 1, wherein the first and second side plates stand up substantially at a right angle from the base plate.

3. The terminal fitting of claim 1, wherein a height difference between an inwardly projecting end of the contact portion and the inner surface of the ceiling plate at the locations disposed laterally of and adjacent to the contact portion is substantially equal to a plate thickness of walls forming the tube.

4. The terminal fitting of claim 1, wherein the contact portion and the bent portion are arranged at opposite sides of a center line of the tube with respect to a width direction and the inwardly projecting end of the contact portion and the inner surface of the bent portion are set substantially at the same height.

5. The terminal fitting of claim 1, wherein part of the contact portion is more backward than a leading end position of the mating terminal when the mating terminal is inserted to a proper depth in the tube.

6. The terminal fitting of claim 1, wherein the contact portion has a substantially semicircular front cross-sectional shape and a height difference between the projecting end of the contact portion and the inner surface of the ceiling plate around the contact portion is substantially equal to a plate thickness of the terminal fitting and the bent portion has a length substantially equal to the formation range of the contact portion in the longitudinal direction.

7. The terminal fitting of claim 1, wherein the inwardly projecting end of the contact portion and the inner surface of the contact portion are at substantially the same height position relative to the base plate.

8. The terminal fitting of claim 1, wherein an outer surface of the bent portion and outer surface areas of the ceiling plate at the locations disposed laterally of and adjacent to the contact portion are at substantially the same height position relative to the base plate.

9. A terminal fitting, comprising a tube for receiving a mating terminal, the tube including:

a base plate with opposite first and second sides;

first and second side plates projecting respectively from the first and second sides of the base plate; and a ceiling plate bent from an end of the first side plate opposite the base plate and extending substantially parallel to the base plate, an extending end edge thereof being supported in contact with a receiving portion formed on the second side plate;

the ceiling plate being shaped to project inwardly of the tube to form a contact portion with the mating terminal;

the extending end edge part of the ceiling plate being deformed inwardly of the tube while maintaining a uniform plate thickness, thereby forming a bent portion, and an outer surface of the bent portion being set at the same height position as or below the inner surface of the ceiling plate at locations disposed laterally of and adjacent to the contact portion; and at least one pressing portion bent from the end of the second side plate opposite the base plate to extend substantially parallel to the base plate so that opening of the ceiling plate is prevented by the contact of the pressing portion with the outer surface of the bent portion, wherein the receiving portion is formed by making at least one cut extending in a longitudinal direction in the second side plate and causing a corresponding portion of the second side plate to project inwardly of the tube so that a cut side becomes a base surface of a substantially semi-conical shape, and an end surface of a projecting part at the cut side is a substantially flat surface substantially perpendicular to the second side plate.

10. A terminal fitting, comprising a tube for receiving a mating terminal, the tube including:

a base plate with opposite first and second sides;

first and second side plates projecting respectively from the first and second sides of the base plate; and a ceiling plate bent from an end of the first side plate opposite the base plate and extending substantially parallel to the base plate, an extending end edge thereof being supported in contact with a receiving portion formed on the second side plate;

the ceiling plate being shaped to project inwardly of the tube to form a contact portion with the mating terminal;

the extending end edge part of the ceiling plate being deformed inwardly of the tube while maintaining a uniform plate thickness, thereby forming a bent portion, and an outer surface of the bent portion being set at the same height position as or below the inner surface of the ceiling plate at locations disposed laterally of and adjacent to the contact portion; and at least one pressing portion bent from an end of the second side plate opposite the base plate to extend substantially in parallel to the base plate so that opening of the ceiling plate is prevented by contact of the pressing portion with the outer surface of the bent portion, wherein the receiving portion is formed by making a pair of cuts extending in a longitudinal direction in the second side plate and spaced apart in a height direction and causing an area between the cuts to project inwardly of the tube to have an arcuate shape, and surfaces formed by the end edges of a projecting part are substantially flat and substantially perpendicular to the second side plate.

* * * * *